US007909193B2

(12) United States Patent
Heath et al.

(10) Patent No.: US 7,909,193 B2
(45) Date of Patent: Mar. 22, 2011

(54) PACKAGING CAP

(75) Inventors: Linda R. Heath, Minneapolis, MN (US); Holly A. Robbins, Minneapolis, MN (US); Jeanette Carrell, Shoreview, MN (US); Sergio Gedanke, Brooklyn, NY (US)

(73) Assignee: Target Brands, Inc., Minneapolis, MN (US)

( * ) Notice: Subject to any disclaimer, the term of this patent is extended or adjusted under 35 U.S.C. 154(b) by 174 days.

(21) Appl. No.: 11/940,829

(22) Filed: Nov. 15, 2007

(65) Prior Publication Data

US 2009/0127259 A1 May 21, 2009

(51) Int. Cl.
*B65D 25/28* (2006.01)

(52) U.S. Cl. ..... 220/212.5; 220/780; 215/228

(58) Field of Classification Search ..... 220/212, 220/200, 212.5, 521, 780; 215/228, DIG. 7; 222/158; 426/115; 73/426, 427
See application file for complete search history.

(56) References Cited

U.S. PATENT DOCUMENTS

| | | | | | |
|---|---|---|---|---|---|
| 343,510 | A | * | 6/1886 | Welsh | 73/427 |
| D96,134 | S | | 7/1935 | Rosengart-Famel | |
| D104,881 | S | | 6/1937 | Rosengart | |
| 2,595,101 | A | * | 4/1952 | Russell | 73/426 |
| 3,156,941 | A | | 11/1964 | Tomaiuolo | |
| 3,526,138 | A | * | 9/1970 | Swett et al. | 73/426 |
| D221,064 | S | | 7/1971 | Warren | D9/261 |
| D259,020 | S | | 4/1981 | Beguin | D9/377 |
| 4,273,247 | A | | 6/1981 | Earls | 215/228 |
| D316,369 | S | | 4/1991 | Thompson | D9/337 |
| 5,009,310 | A | | 4/1991 | Finney | 206/229 |
| 5,065,923 | A | | 11/1991 | Hoefer et al. | 220/694 |
| 5,165,558 | A | | 11/1992 | Cargile | 215/100 |
| 5,407,089 | A | | 4/1995 | Bird et al. | 220/212.5 |
| 5,472,121 | A | | 12/1995 | Silano | 222/158 |
| 5,547,109 | A | | 8/1996 | Robbins, III | 222/158 |
| D396,808 | S | | 8/1998 | Maria Camps et al. | D9/527 |
| 5,791,472 | A | * | 8/1998 | Davis | 206/370 |
| 5,860,742 | A | | 1/1999 | Faircloth, Jr. | 383/80 |
| D422,920 | S | | 4/2000 | Tapp et al. | D9/530 |
| D507,488 | S | | 7/2005 | Golding et al. | D9/528 |
| 2004/0007555 | A1 | | 1/2004 | Steele, IV et al. | 215/228 |
| 2006/0076356 | A1 | * | 4/2006 | Bocola | 220/839 |

OTHER PUBLICATIONS

Protomold, Design Guidelines: Uniform Wall Thickness, http:www.protomold.com/DesignGuidelines_UniformWallThickness.aspx, 3 pages, 1999.

Packaging Digest, Design Trends, 6 pages, http:www.packagingdigest.com/articles/200607/6.php, Jul. 2006.

* cited by examiner

*Primary Examiner* — Anthony Stashick
*Assistant Examiner* — Jeffrey Allen
(74) *Attorney, Agent, or Firm* — Theodore M. Magee; Westman, Champlin & Kelly, P.A.

(57) ABSTRACT

A cap for a package containing granular or particulate food, such as pet food, for example includes a measuring cup portion, which is shaped to cover a sealable cap on the container, and a holding portion designed to be held in one hand while filling the measuring cup portion with the granular food. The holding portion includes a wall thickness, which is the same wall thickness found in other portions of the cap. The top and bottom surfaces of the holding portion have top and bottom protrusions, respectively. The top and bottom protrusions are aligned with each other to provide added thickness in the holding portion that makes it easier to grip the holding portion and that conveys a more substantial feel to the hand to make it easier to hold the cap.

3 Claims, 10 Drawing Sheets

PACKAGING CAP

BACKGROUND

To maintain the health of small animals such as cats and dogs, the amount of food given to the animals must be controlled. Many pet owners over-feed their animals because they do not have a dedicated device for measuring the amount of food provided to the animals. Thus, it is desirable to have a cap that accompanies a pet food container and that can be used to measure the amount of pet food provided to the animal.

Many animal foods have a significant amount of fat, and as such, are slightly greasy to handle. As such, it is also desirable to have a measuring cap that allows the user's hand to be remote from the portion of the cap that is used to measure the food. Providing a holding portion that is separate from the measuring portion is difficult with many plastics since it is desirable to minimize the amount of plastic used for the cap, while at the same time maintaining a consistent wall thickness throughout the cap. When uneven wall thicknesses are used within a single plastic mold, effects such as sink marks and part warpage can occur. However, if the same wall thickness is used for the holding portion as for the measuring portion, the holding portion can feel flimsy and can be difficult for users to hold on to.

The discussion above is merely provided for general background information and is not intended to be used as an aid in determining the scope of the claimed subject matter.

SUMMARY

A cap for a package containing granular or particulate food, such as pet food, for example includes a measuring cup portion, which is shaped to cover a sealable cap on the container, and a holding portion designed to be held in one hand while filling the measuring cup portion with the granular food. The holding portion includes a wall thickness, which is the same wall thickness found in other portions of the cap. The top and/or bottom surfaces of the holding portion have top and/or bottom protrusions, respectively. The top and/or bottom protrusions provide added thickness in the holding portion that makes it easier to grip the holding portion and that conveys a more substantial feel to the hand to make it easier to hold the cap.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
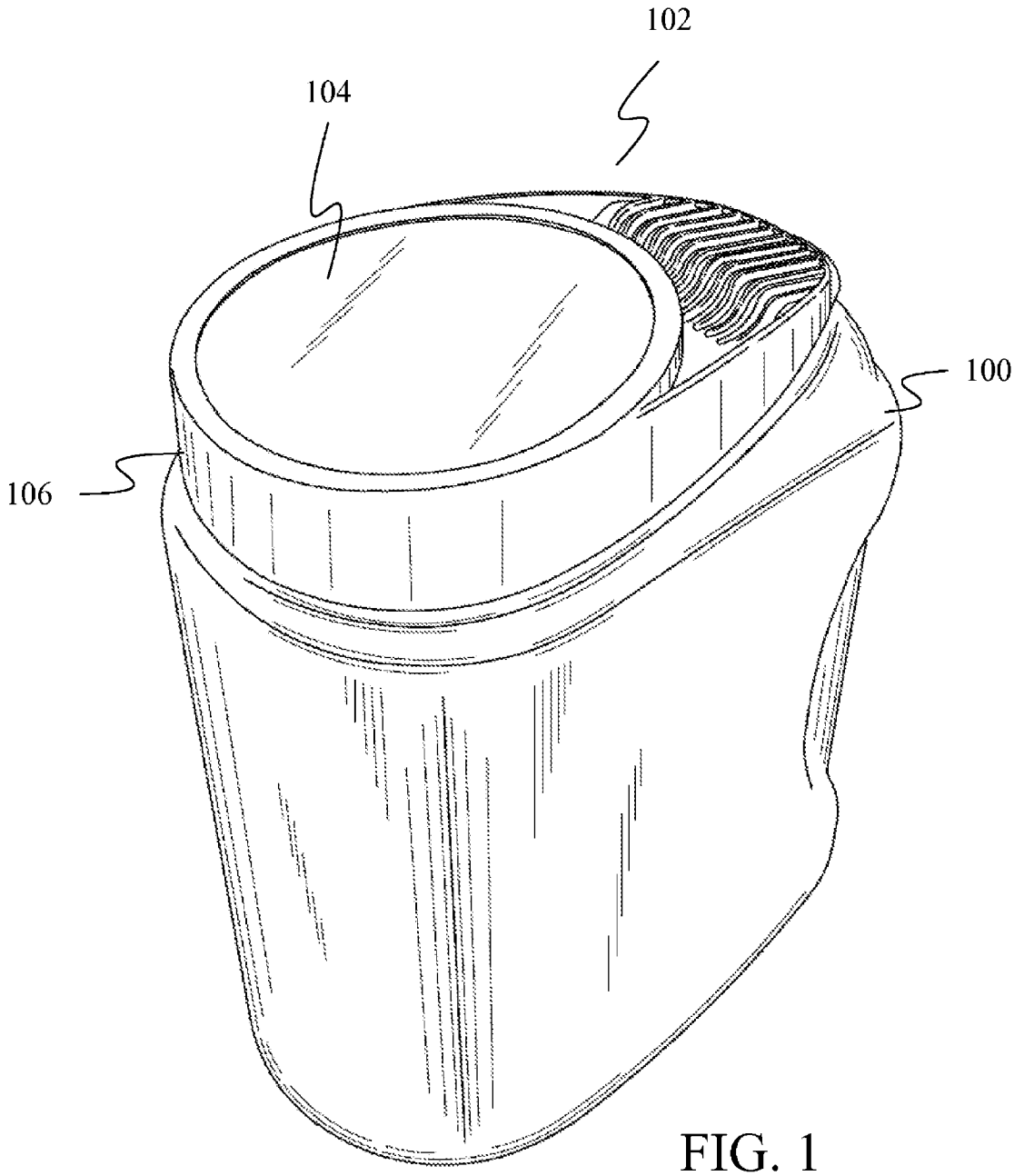
FIG. 1 is a perspective view of a container with a cap under one embodiment.

The present embodiments provide a cap for a package containing granular or particulate food, such as pet food, for example. The cap includes a measuring cup portion, which is shaped to cover a sealable cap on the container, and a holding portion designed to be held in one hand while filling the measuring cup portion with the granular food. The holding portion includes a wall thickness, which is the same wall thickness found in other portions of the cap. The top and bottom surfaces of the holding portion have top and/or bottom protrusions, respectively. Under some embodiments portions of the top protrusions are aligned with portions of the bottom protrusions to provide added thickness in the holding portion that makes it easier to grip the holding portion and that conveys a more substantial feel to the hand to make it easier to hold the cap. The top of the holding portion is below the top of the measuring cap portion to allow the cap to be placed upside down on the floor so that it may be used as a dish for a pet while allowing the user to easily slip their hand underneath the holding portion to retrieve the cap from the floor once the pet has finished eating.

In the discussion below, relative positional terms such as "above" and "below" are used to describe the position of elements relative to each other. It should be understood that these terms are used to provide a description of the elements that is consistent with the orientation of elements in the drawings. Those skilled in the art will recognize that if the elements described below are placed in different orientations, the relative position terms would change accordingly.

Figure 2:
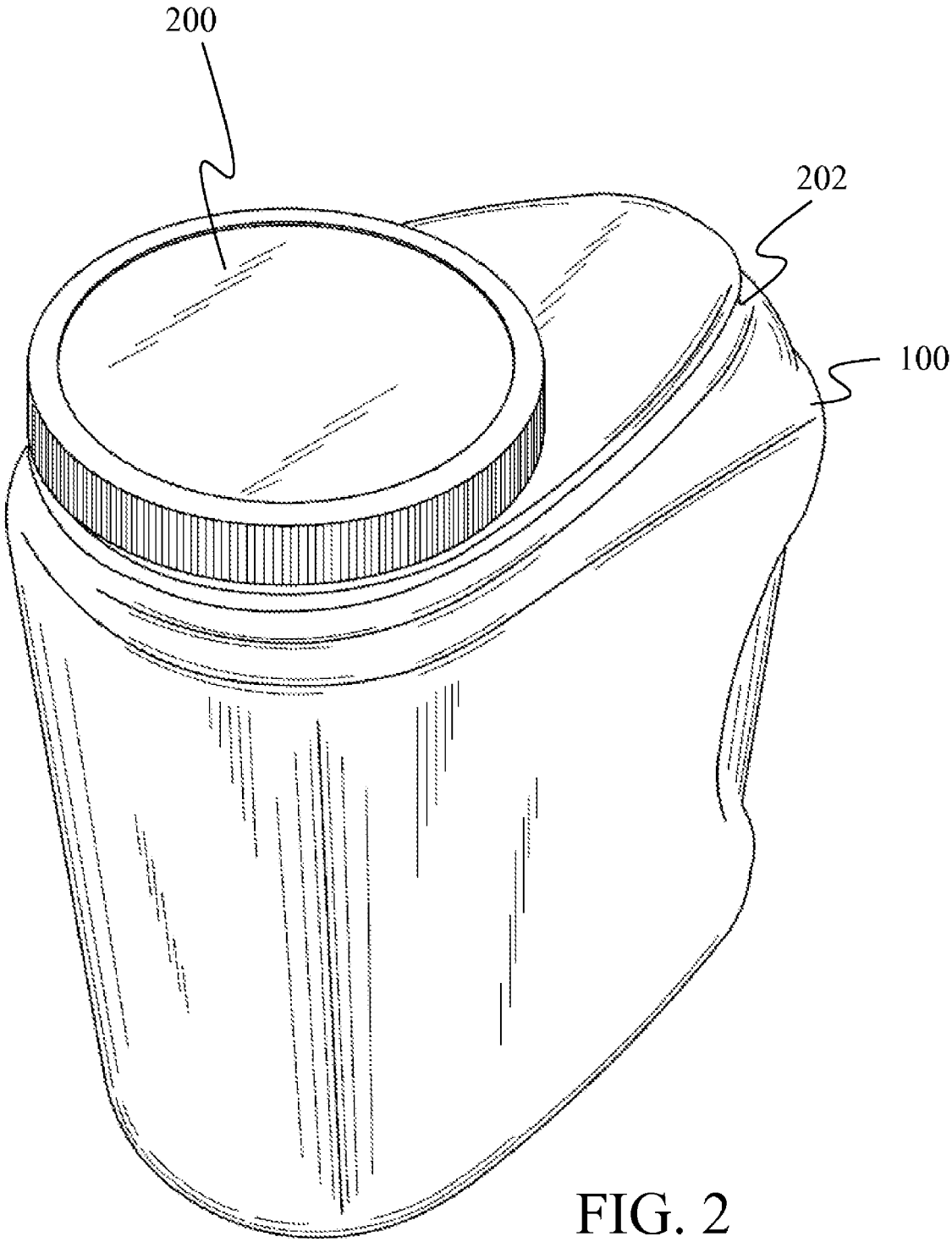
FIG. 2 is a perspective view of the container of FIG. 1 without the cap.

FIGS. 1 and 2 show a container 100 with and without, respectively, a cap 102. Cap 102 includes a cover member 104, which also represents a measuring cup portion, that is sized to fit over a sealing cap 200, which under one embodiment screws onto package 100. Under some embodiments, container 100 contains a granular food product such as pet food.

Container 100 also includes a channel 202 that extends around a top portion of jug 100. As described further below, cap 102 includes a ridge along an interior of a sidewall 106 that engages in channel 202 to maintain cap 102 on jug 100.

Figure 3:
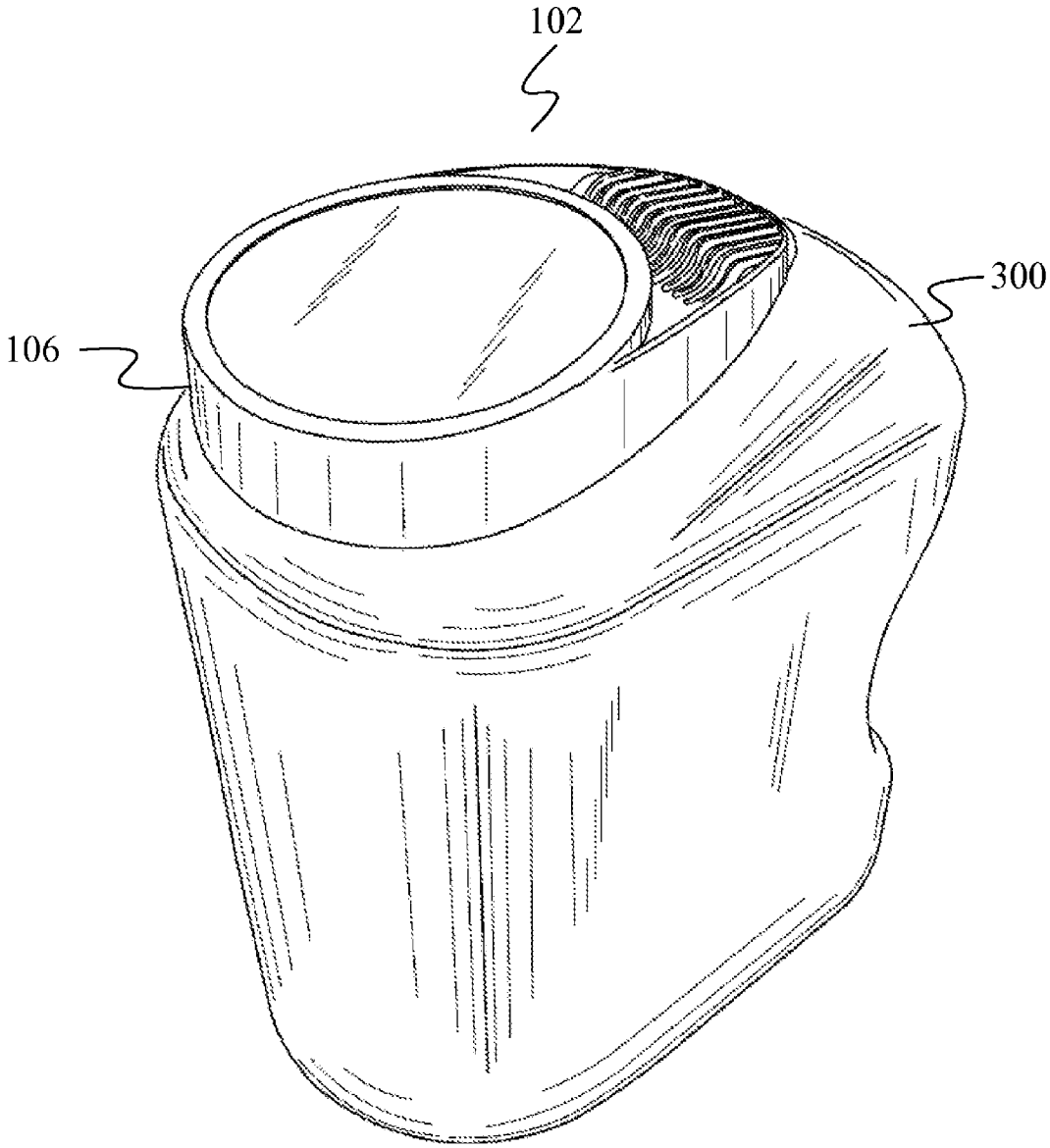
FIG. 3 is a perspective view of a container with a cap under a second embodiment.
Figure 4:
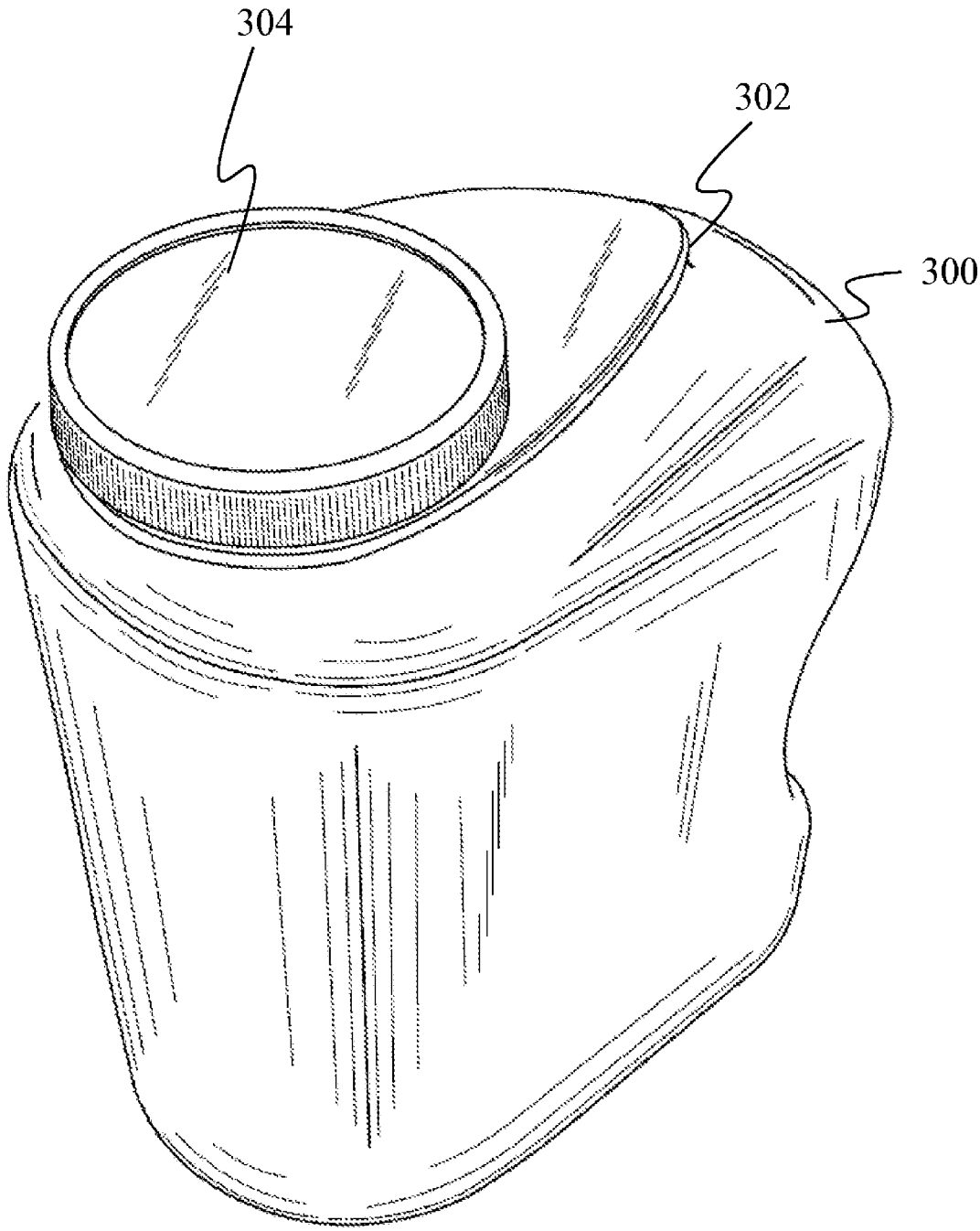
FIG. 4 is a perspective view of the container of FIG. 3 without the cap.

FIG. 3 shows cap 102 placed on a different container 300 and FIG. 4 shows container 300 without cap 102. As shown in FIG. 4, container 300 includes channel 302, which extends around a top portion of container 300. The ridge on the interior of sidewall 106 of cap 102 engages in channel 302 to keep cap 102 on container 300. Container 300 also includes a sealing cap 304, which under one embodiment is a screw-top lid that screws onto container 300. Cover member 104 of cap 102 is sized to fit over sealing cap 304. Under some embodiments, container 300 contains a granular food product such as pet food, for example.

Figure 5:
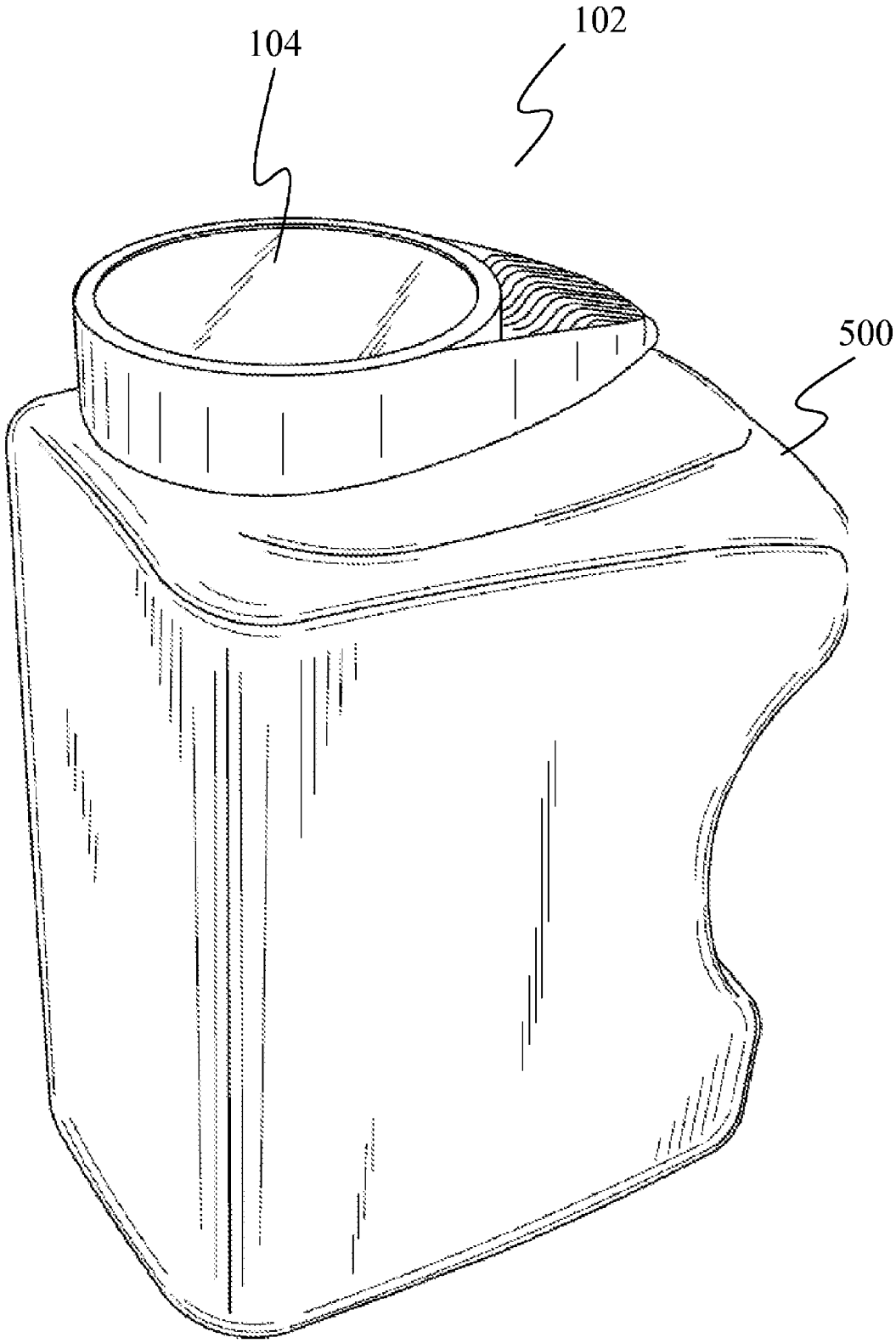
FIG. 5 is a perspective view of a container with a cap under a third embodiment.
Figure 6:
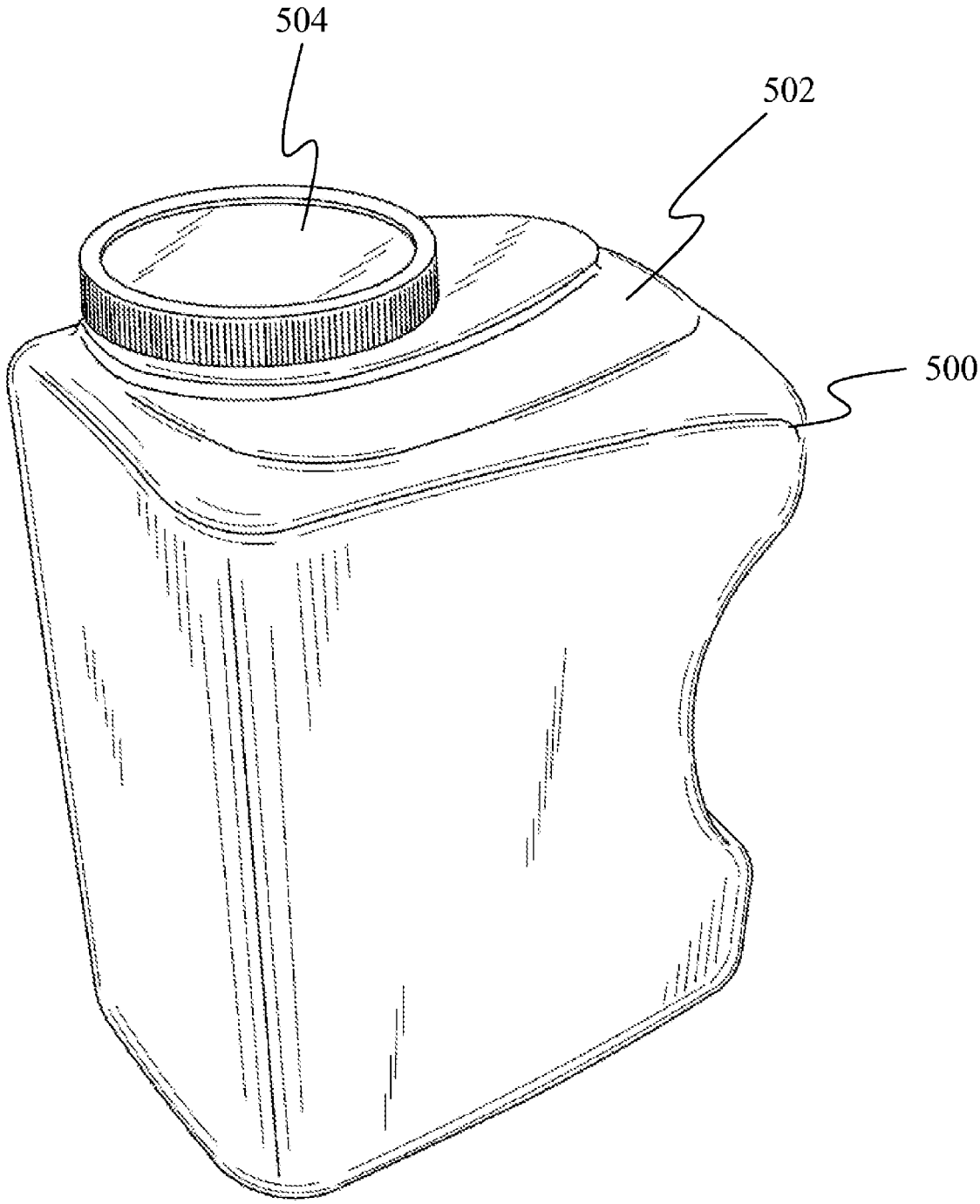
FIG. 6 is a perspective view of the container of FIG. 5 without the cap.

FIG. 5 shows cap 102 positioned on an additional container 500, which is shown without cap 102 in FIG. 6. Container 500 includes channel 502, which extends around a top portion of container 500, and into which the ridge on the interior of sidewall 106 of cap 102 fits to secure cap 102 on container 500. Container 500 also includes a sealing cap 504, which under one embodiment is a screw-top lid that seals to container 500. Cover member 104 of cap 102 is sized to fit over sealing cap 504. Under some embodiments, container 500 contains a granular food product such as pet food.

Containers 100, 300 and 500 each have a different size and shape. However, the same cap 102 fits on all three containers. Thus, a system of containers and caps is provided that allows a single cap to be used with multiple different types of containers. Although three containers have been shown, additional containers of other shapes and/or sizes may be used with cap 102.

Under several embodiments, containers 100, 300, and 500 are constructed of high-density polyethylene, for example. Cap 102 can be constructed of polyethylene terephthalate (PET), polyvinylchloride (PVC) or polypropylene, for example. Other materials may be used for the containers or the cap.

Figure 7:
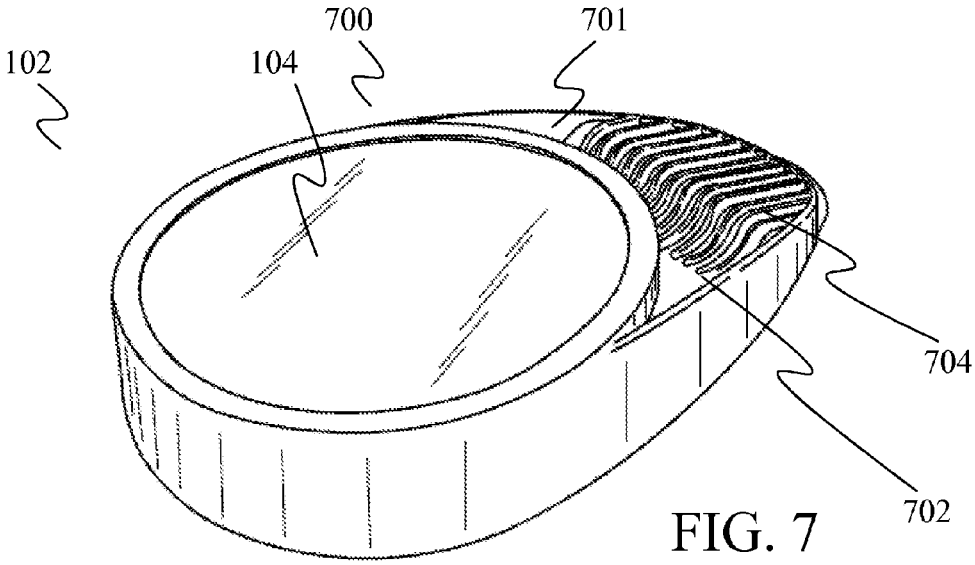
FIG. 7 is a perspective view of a cap of one embodiment.

FIG. 7 provides a perspective view of cap 102. Cap 102 includes an interior portion 700, which is defined at its periphery by sidewall 106. Interior portion 700 includes cover member 104 and holding portion 701. Holding portion 701 includes a recess 702 and top ribs 704, which under one embodiment are protrusions extending from the back of cap 102 toward cover member 104. Under one embodiment, cover member 104 also acts as a measuring cup, and thus can alternatively be referred to as a measuring cup portion 104. Cap 102 has an oblong oval shape with holding portion 701 having an elliptical shape.

Figure 8:
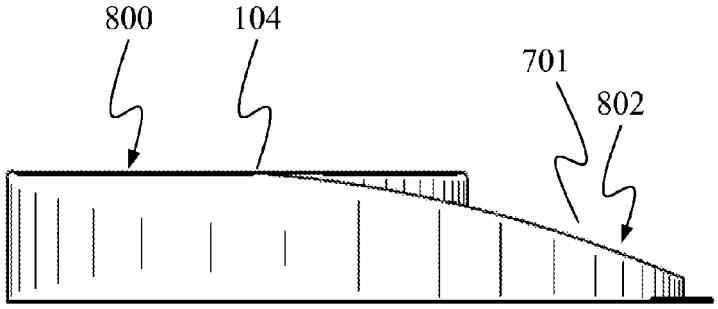
FIG. 8 is a right side view of the cap of FIG. 7.
Figure 9:
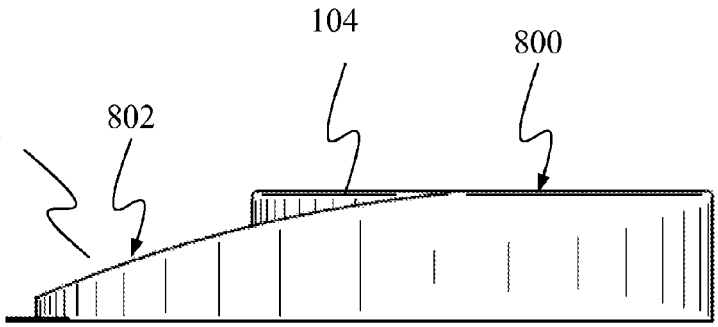
FIG. 9 is a left side view of the cap of FIG. 7.

FIGS. 8 and 9 show side views of cap 102 showing that measuring cup portion 104 has a top 800 and holding portion 701 has a top 802. Top 800 of the measuring cup portion 104 is above top 802 of the holding portion 701. Because of this, when cap 102 is inverted and the top 800 of measuring cup portion 104 is placed on a surface, a space will exist between the surface and the top 802 of holding portion 701. This provides a space for a user's fingers to be placed underneath cap 102 to lift cap 102 off the surface.

Figure 10:
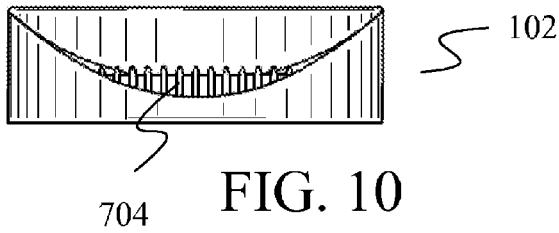
FIG. 10 is a back view of the cap of FIG. 7.
Figure 11:
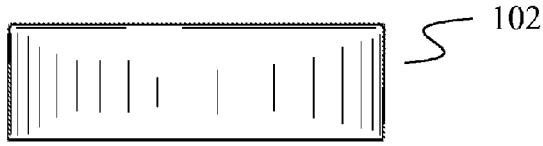
FIG. 11 is the front view of the cap of FIG. 7.

FIGS. 10 and 11 show a back and front view of cap 102. Back view 102 shows top ribs 704 of holding portion 701.

Figure 12:
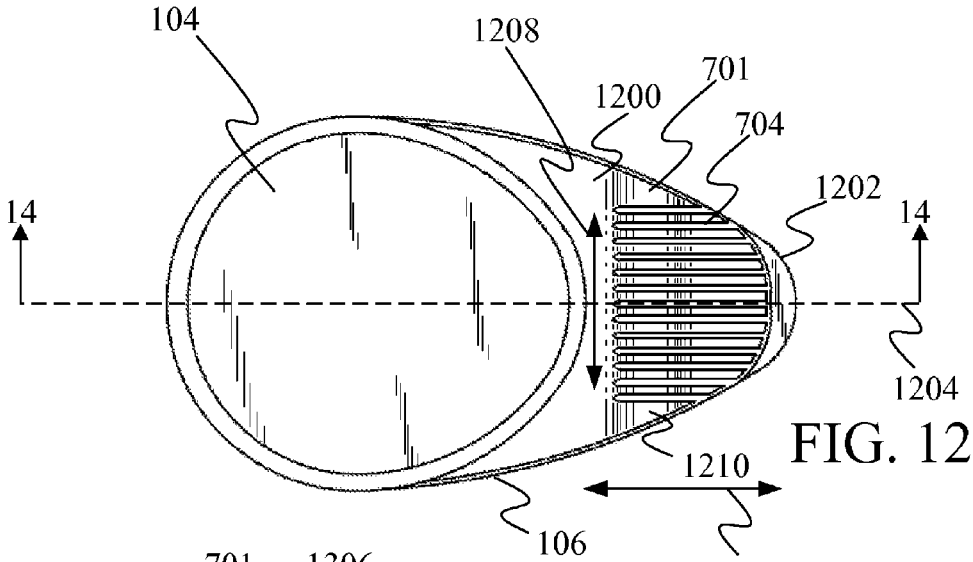
FIG. 12 is the top view of the cap of FIG. 7.

FIG. 12 provides a top view of cap 102 showing measuring cup portion 104, and holding portion 701. Holding portion 701 includes holding member 1210 and top ribs 704 that protrude from a top surface 1200 of holding member 1210. In addition, FIG. 12 shows a tab 1202 extending from sidewall 106 away from measuring cup portion 104 such that at least a portion of holding portion 701 is closer to measuring cup portion 104 than tab 1202. Tab 1202 has a wall thickness that is the same as a wall thickness of holding member 1210. When cap 102 is position on a container, such as containers 100, 300 and 500, tab 1202 extends above or away from the container so that a user can place their finger under tab 1202 to lift cap 102 from the container.

In FIG. 12, it can be seen that cap 102 is symmetric about an axis of symmetry 1204 and that top ribs 704 extend in a direction 1206 that is parallel to the axis of symmetry 1204. Recess 702 extends in a direction 1208 that is perpendicular to direction 1206, under one embodiment.

In FIG. 12, ribs 704 are evenly spaced from each other and have an equal width. In other embodiments, different spacing may be used and variable widths may be applied to the ribs. Ribs 704 end at a common line running perpendicular to the ribs, under one embodiment, with each rib beginning at sidewall 106, under one embodiment.

Figure 13:
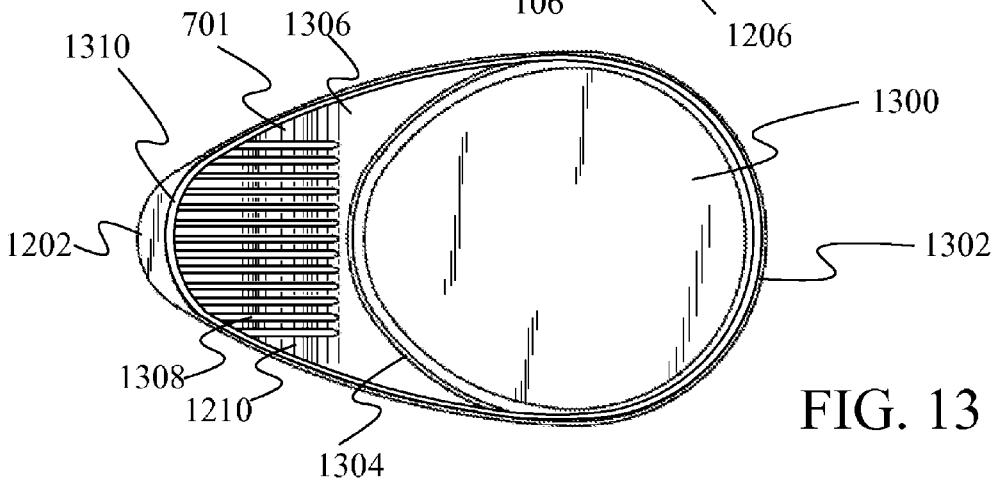
FIG. 13 is a bottom view of the cap of FIG. 7.

FIG. 13 shows a bottom view of cap 102. The bottom view of FIG. 13 shows an interior 1300 of measuring cup portion 104. Interior 1300 is defined by a first sidewall 1302 forming part of sidewall 106 and thereby defining an outer perimeter of cap 102. Interior 1300 of measuring cup portion 104 is further defined by a second sidewall 1304, which separates interior 1300 of measuring cup portion 104 from holding portion 701.

In FIG. 13, holding portion 701 is shown to further include a bottom surface 1306 of holding member 1210 and bottom ribs 1308 that protrude from bottom surface 1306. Under one embodiment, bottom ribs 1308 are linear protrusions that end at a common ending line running perpendicular to bottom ribs 1308. Under one embodiment, bottom ribs 1308 are evenly spaced and have the same width as each other. In addition, under one example embodiment, bottom ribs 1308 are vertically aligned with top ribs 704 and have the same width as top ribs 704. In such embodiments, each rib in bottom ribs 1308 is vertically aligned with a single top rib 704 such that a line along a normal to top surface 1200 or bottom surface 1306 would pass through both a top rib 704 and a bottom rib 1308.

In other embodiments, bottom ribs 1308 extend at an angle to top ribs 704 such that a bottom rib 1308 will cross below a plurality of top ribs 704 and a top rib 704 will cross above a plurality of bottom ribs 1308. In such embodiments, each area where a bottom rib 1308 crosses beneath a top rib 704 forms overlapping protrusions. In still further embodiments, instead of using linear protrusions or ribs, small circular or oblong protrusions are placed on top surface 1200 and bottom surface 1306 such that the small protrusions on the two surfaces overlap each other and such that a line along a normal to top surface 1200 or bottom surface 1306 would pass through both a protrusion on top surface 1200 and a protrusion on bottom surface 1306. In still further embodiments, protrusions are found on either top surface 1200 or bottom surface 1306, but not both.

FIG. 13 also shows a ridge 1310 located on the interior of sidewall 106. Ridge 1310 is designed to fit or engage within channels 202, 302 and 502 of the food containers of FIGS. 2, 4 and 6, respectively.

Figure 14:
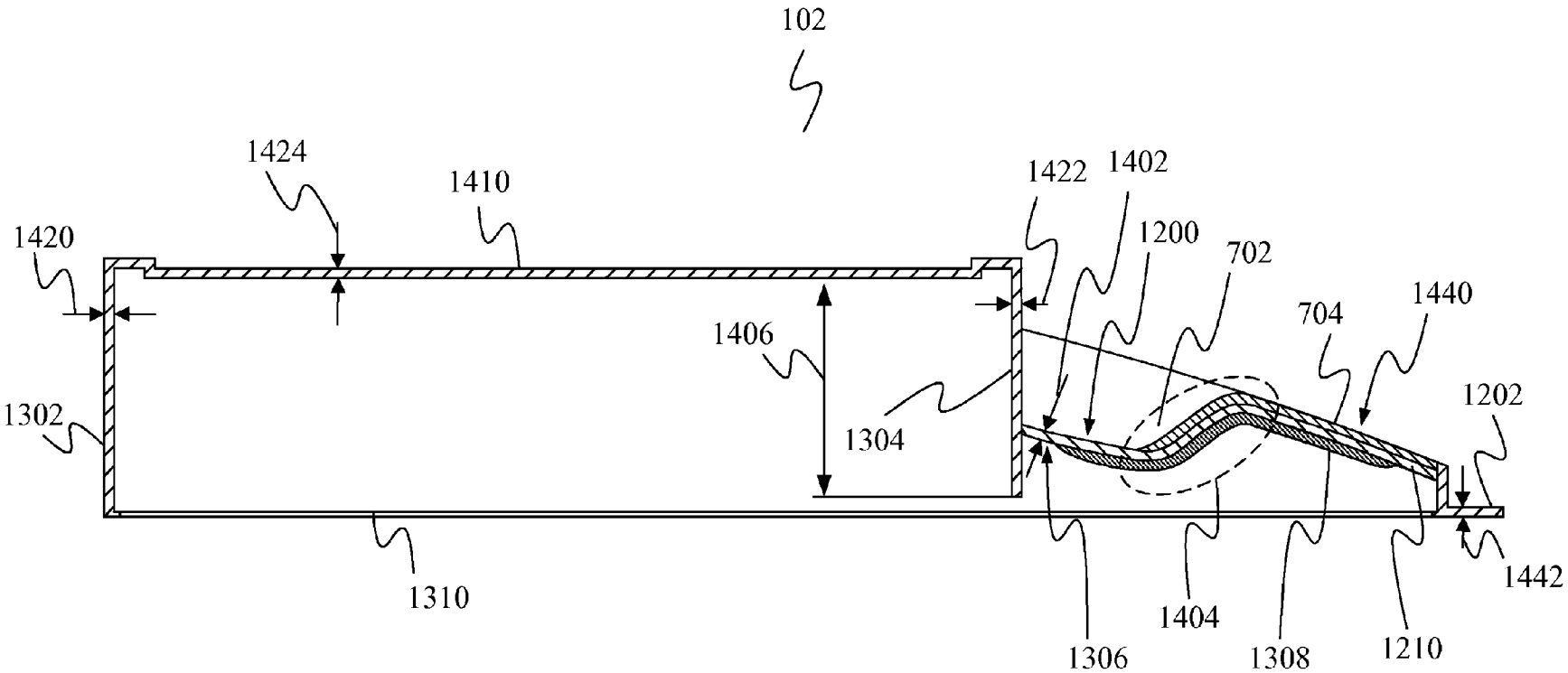
FIG. 14 is a side cross-sectional side view of the cap of FIG. 7.

FIG. 14 shows a cross-sectional side view of cap 102 taken along axis of symmetry 1204 as shown in FIG. 12. As shown in FIG. 14, first sidewall 1302, top member 1410 and second sidewall 1304 have wall thicknesses 1420, 1422, and 1424, respectively, that are the same as a wall thickness 1402 of holding member 1210 and a wall thickness 1442 of tab 1202. Holding member 1210 includes top surface 1200 and bottom surface 1306 with top rib 704 extending along top surface 1200 and bottom rib 1308 extending along bottom surface 1306. Holding member 1210 has a planar portion 1440 and a recess or concave portion 702 that is formed by a contour, shown in dotted circle 1404, in top surface 1200 and bottom surface 1306. Top rib 704 and bottom rib 1308 follow the contour 1404, under one embodiment. Bottom rib 1308 extends closer to measuring cup portion 104 than top rib 704. Planar portion 1440 extends along a plane that intersects with a horizontal plane that top member 1410 of cap portion 104 extends along.

Second sidewall 1304 has a height 1406 that together with the interior area of top member 1410 defines a measuring cup volume. Under one embodiment, this measuring cup volume is one cup, for example.

Figure 15:
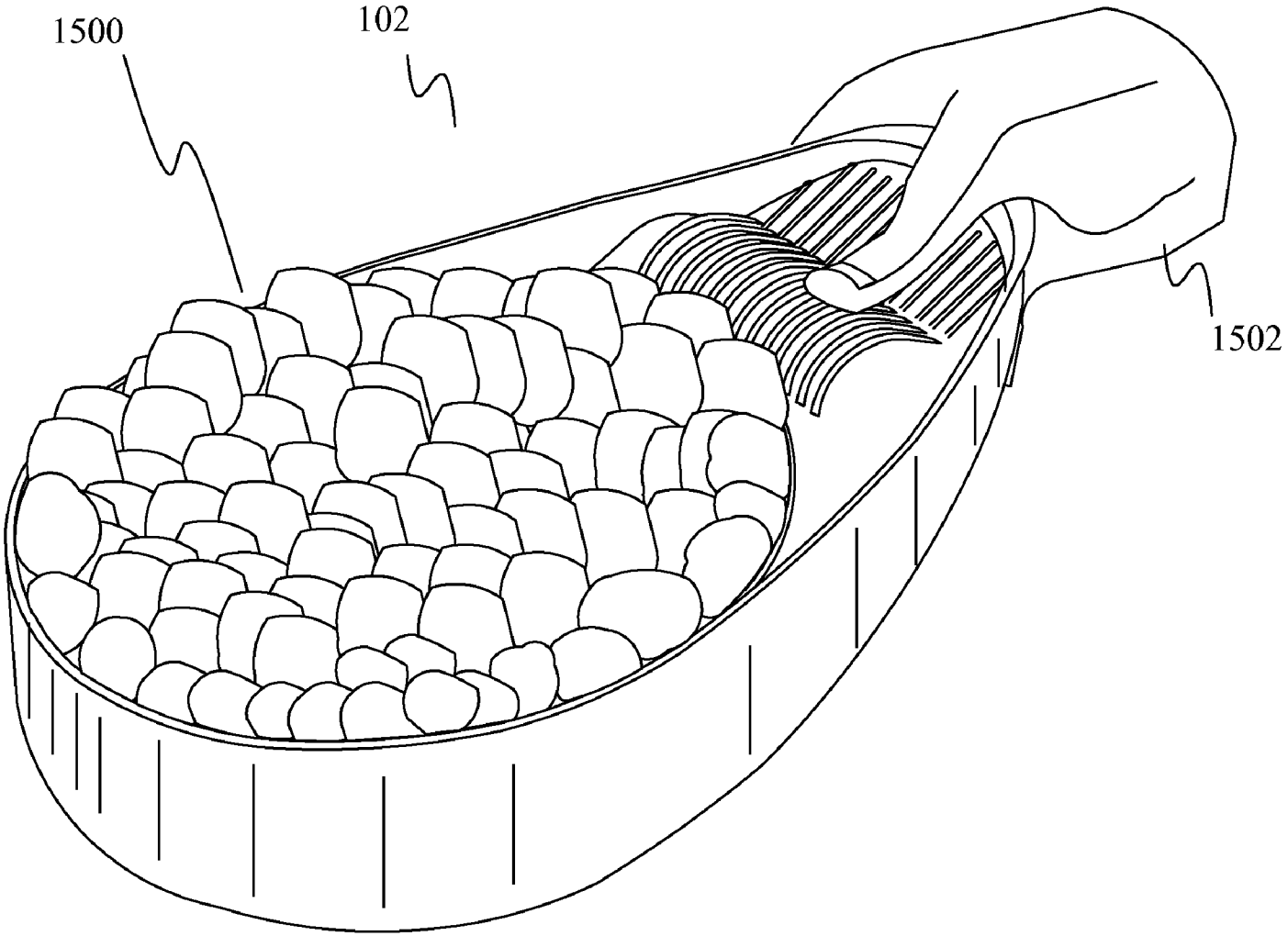
FIG. 15 is a perspective view of a cap with material in the measuring cup and a hand holding the cap.

FIG. 15 shows a perspective view of cap 102 with interior cup section 1300 filled with granular food product 1500, such as pet food, for example. In FIG. 15, a consumer's hand 1502 is shown gripping holding portion 701. Because ribs 704 and 1308 are aligned on top of each other vertically as shown in FIG. 14, when the user's hand 1502 grips the holding portion 701, they feel the thickness of bottom rib 1308, the wall thickness of holding member 1210, and the thickness of rib 704. This added thickness is achieved while maintaining a uniform wall thickness throughout cap 102. Specifically, the wall thickness 1402 of holding member 1210 is the same as the wall thicknesses 1420, 1422, and 1424 of measuring cup portion 104. This uniform wall thickness helps to avoid sinks and warpage while the placement of the ribs in vertical alignment with each other provides the feel of added thickness, thus making it easier for users to retain a grip on cap 102. In embodiments with other protrusion shapes or orientations, the user will also feel the thickness of the protrusion on bottom surface 1306, the thickness of the protrusion on top surface 1200, and the wall thickness of holding member 1210. Note that the protrusions should be shaped so that the protrusions have a similar cooling rate as the walls of cap 102 during molding of cap 102.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A cap comprising:

a measuring cup portion having an oblong oval shape sized to fit over a sealable cap that screws on a container and having an interior defined in part by a first sidewall and a second sidewall, at least one ridge extending along an inner surface of the portion of the first sidewall that partially defines the measuring cup portion for engaging a recess in a container, the first sidewall having a wall thickness; and a holding portion separated from the interior of the measuring cup portion by the second sidewall and defined at its periphery by the first sidewall, the holding portion having a planar portion and a recess portion and having a top surface and a bottom surface opposite each other and having a wall thickness that is the same as the wall thickness of the sidewall, the top surface comprising a set of linear top ribs and the bottom surface comprising a set of linear bottom ribs, each of the top ribs being aligned with a respective bottom rib, each rib of the set of bottom ribs ending at a second common line along the bottom surface perpendicular to the ribs with the bottom ribs extending closer to the measuring cup portion than the top ribs, wherein the ribs are shaped so that the ribs have a similar cooling rate as the first sidewall during molding of the cap, each rib of the set of top ribs and each rib of the set of bottom ribs extending along the planar portion and following a contour that forms the recess portion at least one ridge extending along an inner surface of the portion of the first sidewall that defines the periphery of the holding portion for engaging a recess in a container wherein the cap is symmetric about an axis of symmetry, wherein the axis of symmetry is a longitudinal axis of the oblong oval shape of the measuring cup portion, and the top ribs and the bottom ribs extend in a direction that is parallel to the axis of symmetry with the recess extending in a direction that is perpendicular to the axis of symmetry.

2. The cap of claim 1 wherein the holding portion further comprises a tab extending from an outer surface of the first sidewall such that at least a portion of the holding member is closer to the cover member than the tab.

3. The cap of claim 1 wherein the cap is fit onto a package containing a food product.

* * * * *